US005766035A

United States Patent [19]

Alibert

[11] Patent Number: 5,766,035

[45] Date of Patent: Jun. 16, 1998

[54] DEVICE FORMING A PLUG BASE FOR AN ELECTRIC RELAY

[75] Inventor: Jean-Luc Alibert, Evreux, France

[73] Assignee: Connecteurs Electriques Deutsch, Evreux Cedex, France

[21] Appl. No.: 442,036

[22] Filed: May 16, 1995

[30] Foreign Application Priority Data

Jun. 24, 1994 [FR] France ..... 94 07841

[51] Int. Cl.[6] ..... H01R 13/74

[52] U.S. Cl. ..... 439/557; 439/362

[58] Field of Search ..... 439/557, 558, 439/362

[56] References Cited

U.S. PATENT DOCUMENTS

| | | | |
|---|---|---|---|
| 3,244,941 | 4/1966 | Maynard et al. . | |
| 4,634,203 | 1/1987 | Noyes | 439/557 |
| 5,238,426 | 8/1993 | Arnett | 439/557 |
| 5,372,523 | 12/1994 | Sakatani et al. | 439/557 |
| 5,525,074 | 6/1996 | Tsuji et al. | 439/557 |

FOREIGN PATENT DOCUMENTS

| | | |
|---|---|---|
| 2153752 | 9/1971 | France . |
| 42 02 849 | 6/1993 | Germany . |

*Primary Examiner*—Gary F. Paumen
*Attorney, Agent, or Firm*—Lowe, Price, LeBlanc & Becker

[57] ABSTRACT

A device of forming a plug base for an electric relay to be fit through an opening in a panel is disclosed. The device comprises a body having a plurality of electric sockets and a width. An electric relay is part of the device and has pins engageable in respective electric sockets of the body and has a plug position where the sockets and the pins are engaged in an approach position where the sockets and pins are in contact. Snap-in resilient lugs are mounted adjacent the body and are flexible between a first position where the lugs are elastically contracted towards the center of the body and a second position in which the lugs are in a normal, non-contracted position. Each of the lugs has a width substantially equal to the width of the body. The relay, when the relay is in the plug and the approach positions, prevents the resilient lugs from moving to the first position.

9 Claims, 4 Drawing Sheets

DEVICE FORMING A PLUG BASE FOR AN ELECTRIC RELAY

BACKGROUND OF THE INVENTION

1. Field of the Invention

This invention relates to a device forming a plug base for an electric relay.

2. Description of the Prior Art

In the aeronautical field, the electric control panels usually used comprise a plurality of electric relays situated on one side of the panel with each plugged into a corresponding base by a detachable mechanical link. More precisely, in order to achieve this assembly of electric relays, holes with standardized contours are firstly bored and cut out in a panel of predetermined thickness. A plug base is then inserted through the holes with small securing columns in front and at the rear of the panel, in such a way that the small columns protrude from the holes, while maintaining the base in position, washers are inserted onto the small columns before securing the latter to the panel by tightening nuts to a predetermined torque. The electric relay is then plugged into the base so that the bored securing lugs of the relay are positioned on the small columns. Finally, other washers are inserted onto the small columns and the relay is secured to the base and to the panel by tightening other nuts to a predetermined torque.

This securing method is efficient, but leads to a relatively lengthy implementation due to the successive positioning of the washers and successive tightening of the nuts, and comprises a major risk in terms of the operating reliability in the event of loss of these washers or nuts which are liable to cause short-circuiting or unwanted grounding.

The aim of this invention is to perfect the technology of installing electrical control panels by simplifying the implementation of the securing of the bases to the electric panels and by suppressing the risk of loss of detached parts or small metal objects, by the use of a new device forming a plug base.

OBJECT OF THE INVENTION

The object of the invention is to provide a device forming a plug base for an electric relay through an opening in a panel, of the type comprising two joining pieces fitted with securing means and arranged on each side of a body fitted with housings forming the sockets of an electric connector, wherein the device comprises snap-in resilient lugs that are flexible between two positions, of which the first corresponds to an elastic contraction of the lugs towards the center of the body, and of which the second corresponds to a distance between said lugs substantially equal to distance between two sides of the electric relay to be plugged in.

SUMMARY OF THE INVENTION

According to other features of the invention:

- the resilient lugs comprise a shoulder forming a snap-in jaw arranged in the snapped-in position with a predetermined clearance in relation to the corresponding face of the panel;
- the resilient lugs comprise a sloped plane determined so as to cause elastic retraction of the lugs when the device is inserted through the corresponding opening in the panel;
- the resilient lugs are maintained spread apart in the blocking position by the electric relay when the electric relay is presented in the approach position;

- the resilient lugs are delimited by blind vertical grooves in the body;
- resilient lugs meet above a joining piece;
- the resilient lugs are at least partially recessed;
- the at least partial recess in the resilient lugs is provided for the passage of a sleeve tube forming a distance sleeve integral with the electric relay;
- the base is comprised of two assembled parts, the first part comprising a central block and resilient snap-in lugs, the second part comprising a cradle formed to receive the first part;
- the cradle has two lateral surfaces intended to constitute bearing surfaces for the lugs;
- the cradle has a bottom surface intended to be receive the first part, their mutual fixing being achieved by welding or glueing;
- the securing means are internal screw threads or mounted tapped inserts;
- the securing means of the device cooperate with complementary securing means of the electric relay made captive in relation to said relay;
- indexing slugs are provided for the positioning of the base in a panel opening susceptible of receiving a series of bases;
- the indexing slugs are arranged on the joining pieces of the base, so as to engage with orifices in the panel;
- the indexing slugs are arranged laterally, in an area corresponding to the thickness of the panel, so as to engage in oblong holes arranged laterally in relation to the opening in the panel.

BRIEF DESCRIPTION OF THE DRAWINGS

Further features and advantages of the invention will be apparent from the embodiments of the invention described, by way of non-limiting examples, in reference to the corresponding accompanying drawings in which:

FIG. 4 schematically represents a partial longitudinal section of a device according to the invention in the secured position, with a relay fully plugged in.

DESCRIPTION OF THE PREFERRED EMBODIMENTS

Figure 1B:
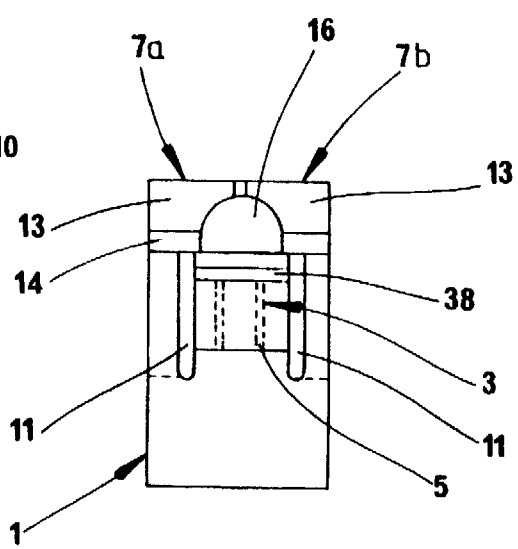
FIGS. 1A to 1C respectively and schematically represent a partial longitudinal section along the line A—A of FIG. 1C, a view according to arrow 8 in FIG. 1A, and a view according to arrow C in FIG. 1A.
Figure 1A:
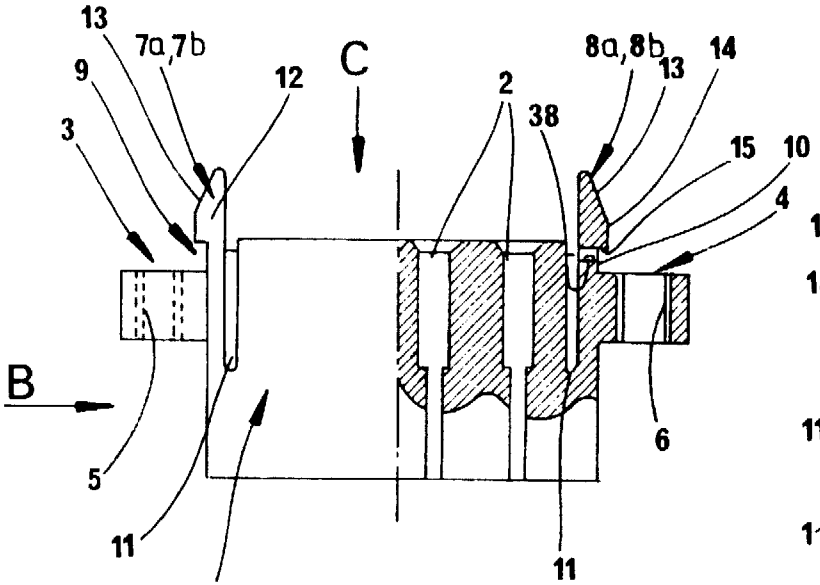
Figure 1C:
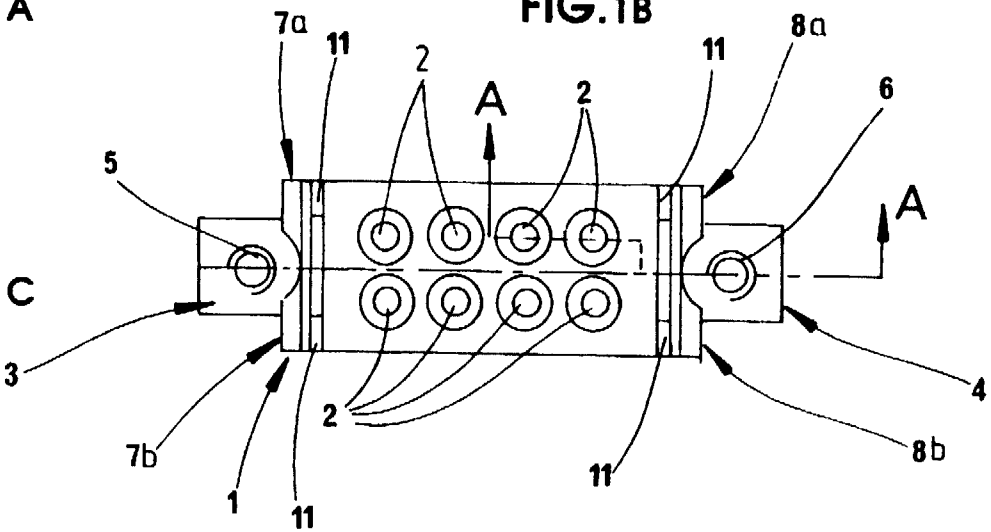

In reference to FIG. 1, a device according to the invention comprises a body 1 fitted with housings 2 forming the sockets of electric connectors capable of engaging with the pins or plugs of connectors of an electric relay that is not represented, so as to electrically plug the electric relay and mechanical securing into the body 1 and into a mounting panel that is not shown.

At the ends of the body 1, two joining pieces 3 and 4 comprise internal screw threads 5 and 6. Alternatively mounted inserts forming internal screw threads, a bayonet system, a quarter turn blocking system, or a push-pull system can be used. On each side of each joining piece 3, 4 and adjacent the body 1, a pair of flexible snap-in lugs 7*a*, 7*b* or 8*a*, 8*b* are arranged so as to form a snap-in groove 9 or 10 of height exceeding the thickness of the receiving panel.

The flexible lugs 7*a*, 7*b*, 8*a*, 8*b* are delimited by blind vertical grooves 11 oriented longitudinally and at right angles to the body 1, and have toes 12 overhanging the grooves 9 and 10.

The functional clearance of the resilient lugs is limited by two guiding planes integral with the base such that said lugs always operate within optimum functional limits.

Each lug 12 comprises a sloped engagement plane 13, a flat surface 14 and a shoulder 15 forming a snap-in jaw. The slopped planes meet above each joining piece 3 or 4 and are interrupted in the region of the medium longitudinal axis by a cylindrical recess 16 that is substantially coaxial with the bore 5 or 6. The recess 16 is provided for the passage of a sleeve 36 which will be described hereinunder.

Similarly, the planes 14 are interrupted in the region of the median longitudinal axis by the cylindrical recess 16 according to an intersection comprising two segments of vertical generating lines.

Figure 2:
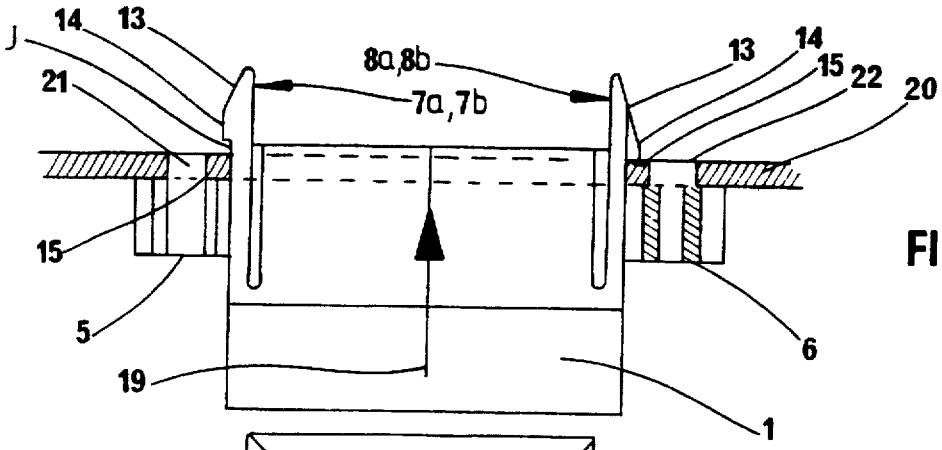
FIG. 2 schematically represents a partial longitudinal section of a first embodiment of a device according to the invention mounted on a panel.
Figure 3:
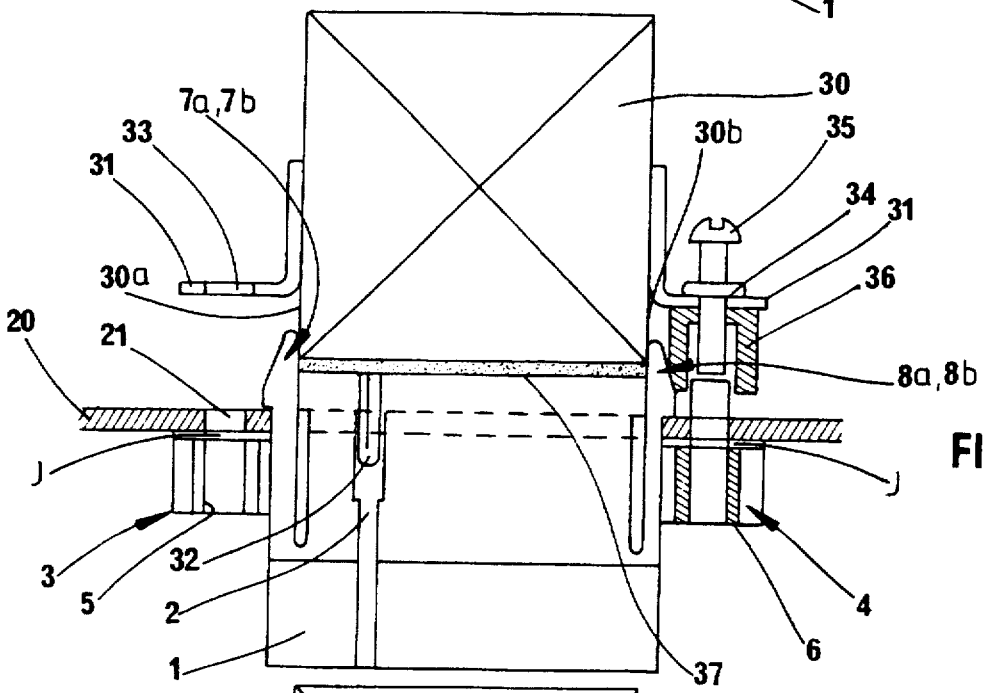
FIG. 3 schematically represents a partial longitudinal section of a device according to the invention with a relay in the approach position.
Figure 4:
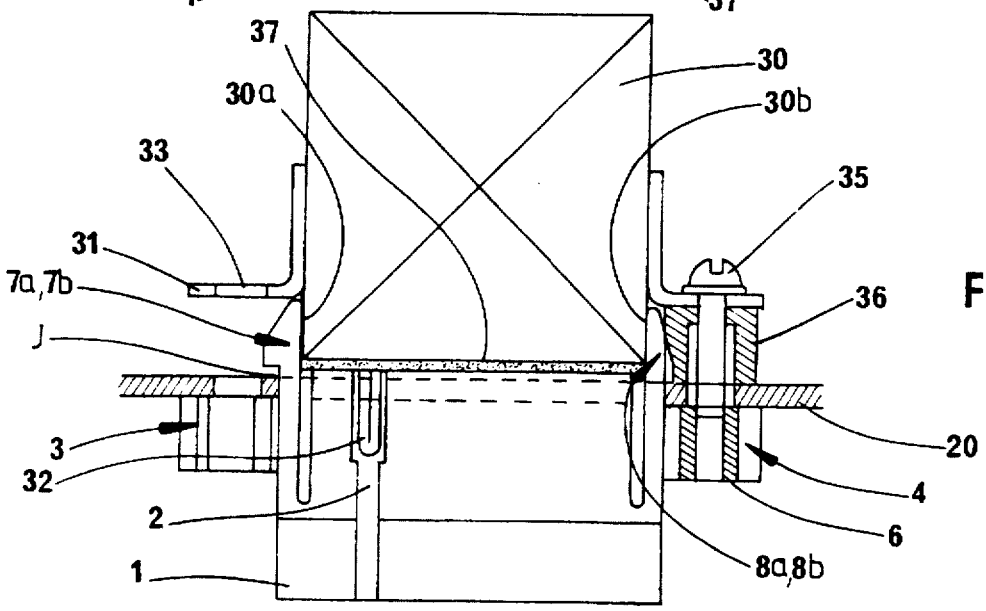

In reference to FIGS. 2 to 4, the device embodying the invention is inserted through a standardized hole cut out of a panel 20, such that the internal screw threads or inserts 5 or 6 are substantially coaxial with the bores 21 and 22 in the panel 20.

Advantageously, inserts 5, 6 project above the upper face of joining pieces 3, 4, with an optional narrowing in the plane of the upper face in order to provide for indexing by entering in the bores 21, 22 of panel 20.

This insertion is achieved by a simple push in the direction of the arrow 19: this pushing motion causes elastic retraction of the resilient lugs 7*a*, 7*b*, 8*a*, 8*b* towards the center of the body 1 due to the action of the opening in the panel 20 on the sloped planes 13 of the flexible lugs 7*a*, 7*b*, 8*a*, 8*b*. The vertical planes 14 then slide on the edges of the opening in the panel 20, and the lugs 7*a*, 7*b*, 8*a*, 8*b* spring back such that shoulders 15 form snap-in jaw above the corresponding edges of the opening.

In the position of maximum insertion in FIG. 2, a clearance j is provided between the snap-in shoulder 15 and the upper surface opposite the panel 20; the clearance j enables mounting on panels of variable thickness within a small range of variation, and effectively ensures proper blocking of the resilient lugs 7*a*, 7*b*, 8*a*, 8*b* in the opening cut out of the panel 20, even in the presence of impurities or dust.

After snapping the device embodying the invention into the opening in the panel 20, the relay 30 with its securing lugs 31 is presented in the approach position shown in FIG. 3.

In this position, when the contact plugs 32 begin entering the electric connector sockets 2 of the body 1, the relay maintains, by way of its lateral sides 30*a* and 30*b*, the resilient lugs 7*a*, 7*b*, 8*a*, 8*b* in blockage position.

To this end, the overall width of the lugs 7*a*, 7*b* and the lugs 8*a*, 8*b* is provided substantially corresponding to the width of the relay 30. This arrangement prevents the device embodying the invention from being freed when the panel 20 is opened: in fact, complete plugging in of the electric connectors requires a considerable thrust in the opposite direction to the arrow 19 in FIG. 2 and this thrust could cause the device to be released by elastic retraction of the lugs 7*a*, 7*b*, 8*a*, 8*b* towards the center of the body 1 if these lugs were not maintained spread apart in the blocked position by the lateral sides 30*a*, 30*b* of the electric relay 30.

The plugging thrust pushes the body 1 downwards, so that the above-mentioned clearance j which appeared above the panel 20 in FIG. 2 is to be found below the panel 20 in FIG. 3.

Thus, the resilient lugs in the spread-apart position rest on the face of the panel by way of their shoulders 15 forming a snap-in jaw, and are automatically blocked in this position by the electric relay when the latter is presented in the approach position.

After being placed in the approach position in FIG. 3, the electric relay 30 is secured to the device embodying the invention via the panel 20.

For this purpose, on the securing lugs 31 bored with holes 33 and 34 are mounted screws 35 fitted with bearing washers made captive by tightening into sleeve tubes 36 forming distance sleeves and tapped at their upper ends. These sleeve tubes 36 are either mounted on or integral with the securing lugs 31, and enable a standard relay to be adapted onto the base according to the invention.

The screws 35 are then screwed into the internal screw threads or tapped inserts 5 or 6 and tightened to a predetermined torque so as to firmly maintain the panel 20 between the relay 30 and the device embodying the invention, more precisely between an end 3 or 4 and a sleeve tube forming a distance sleeve 36.

In the relay securing position in FIG. 4, the above-mentioned clearance j is situated above the panel 20 and the resilient lugs 7*a*, 7*b*, 8*a*, 8*b* are kept spread apart by the lateral sides 30*a*, 30 *b* of the electric relay 30.

A flexible tightness seal 37 between the upper side of the panel 20 and the lower side of the relay 30 bearing the plugs 32 is advantageously provided to ensure the tightness of this interface, irrespective of the variations in the thickness of the panel 20 within an admissible range of variations.

This flexible seal 37 further confers an elastic reaction preventing the propagation of vibrations liable to loosen the screws 35 or to cause unwanted play in the electric and mechanical connections of the relay 30 and device embodying the invention.

Figure 5:
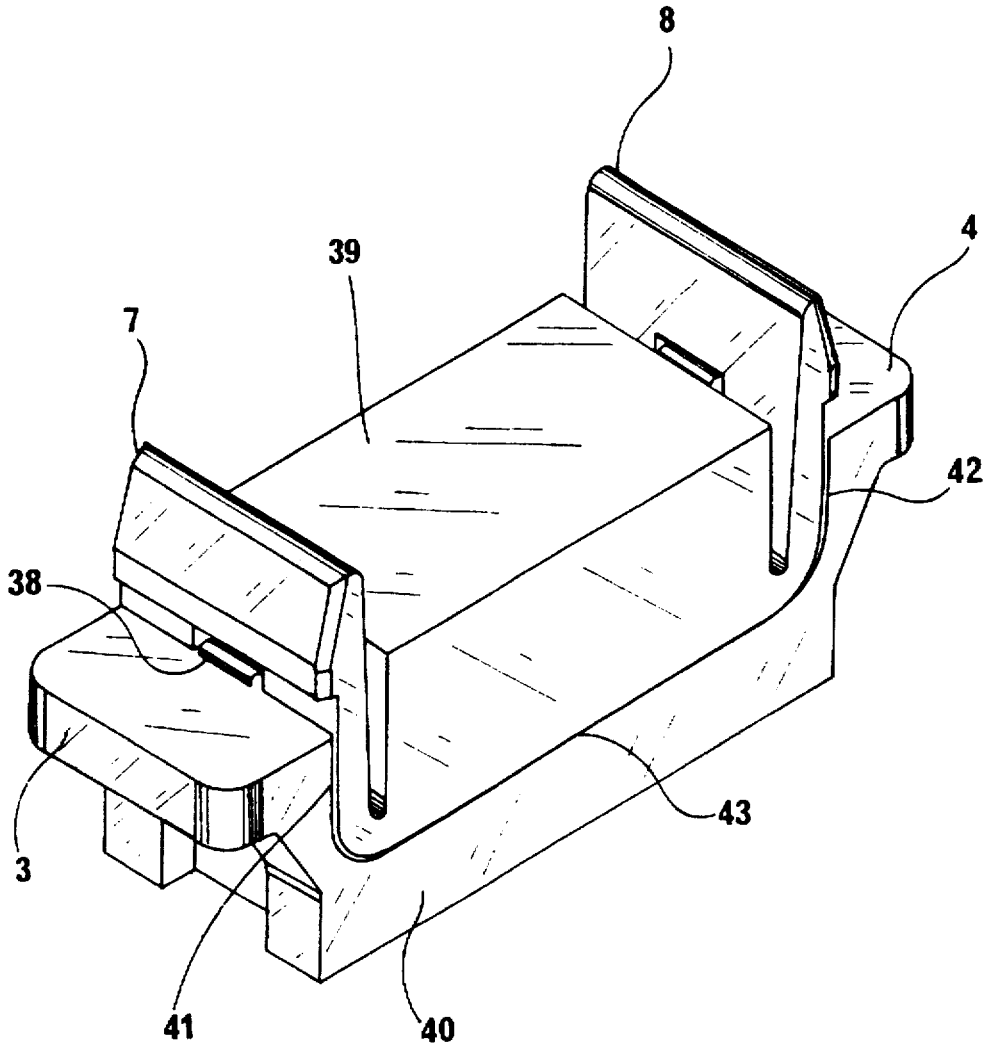
FIG. 5 schematically represents, in perspective, a second embodiment of a device according to the invention.

In the second embodiment in FIG. 5, the device forming a plug-in base is comprised of two parts assembled e.g. by glueing or welding. The first part comprises a central block 39 and resilient snap-in lugs 7 and 8. The central block 39 has housings 2 forming electric connectors, like the body 1 in FIGS. 1 to 4, but which are not represented in order to simplify the drawing. The resilient lugs are constituted in a single piece but comprise a recess in their central zone.

The second part constitutes a cradle 40 extending between the two joining pieces 3 and 4, of which the internal screw threads have not been represented for the purposes of simplification. The cradle 40 is formed to receive the first part of the device over a bottom surface 43 and between two lateral surfaces 41 and 42. The bottom surface 43 is intended to receive the first part of the device so as to perform an assembly by welding or glueing.

The two lateral surfaces 41 and 42 are intended to constitute bearing surfaces or stop surfaces for the lug 7 and 8, respectively.

The joining pieces 3 and 4 penetrate the recesses of the central zone of the lugs 7 and 8, bringing with them a catch 38 that can also be seen in FIGS. 1A and 1B. This catch 38 is intended to apply itself against an edge of the opening in the panel 20, so as to avoid the base translating in the plane of the panel under the effects of the strains caused by the electric connection cables before installation of the relay 30. In fact, in the event of translation of the base, one of the lugs could bend in towards the center of the base and the other lug could then slip out of the panel, in which case the base would no longer be snapped into the panel. The catches 38 enables this drawback to be avoided.

Figure 6:
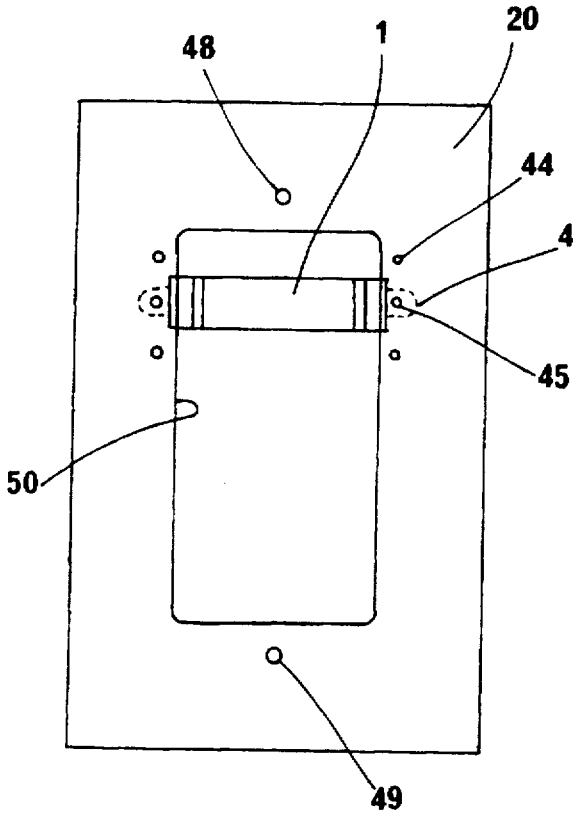
FIG. 6 represents a panel susceptible of receiving a series of devices according to the invention, corresponding to a third embodiment.

FIG. 6 corresponds to the case of an opening in the panel 20 susceptible of receiving a series of devices forming bases for the plugging in of relays, of which only one is represented. In order to simplify the installation of the relays in the corresponding bases, the relays are not individually screwed into the bases, but are plugged in and maintained in the plugged-in position by means of a frame applied on all the relays and secured by two screws, e.g. at 48 and 49. This frame extends substantially over the circumference of the opening 50 in the panel 20.

Figure 7:
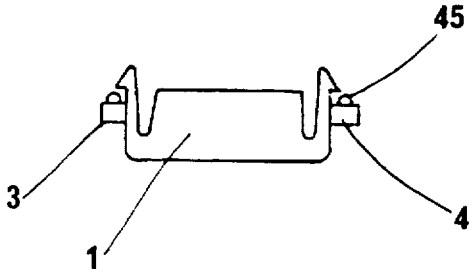
FIG. 7 is a front view of the device in FIG. 6.

In order to properly position the bases 1 in the opening 50 in the panel 20, evenly spaced orifices 44 are provided in the panel 20, on each side of the opening 50. In the third embodiment shown in FIGS. 6 and 7, the joining pieces 3 and 4 of the bases 1 comprise indexing lugs 45 intended to be inserted into the orifices 44 when the bases are positioned in the opening 50 in the panel 20.

Figure 8:
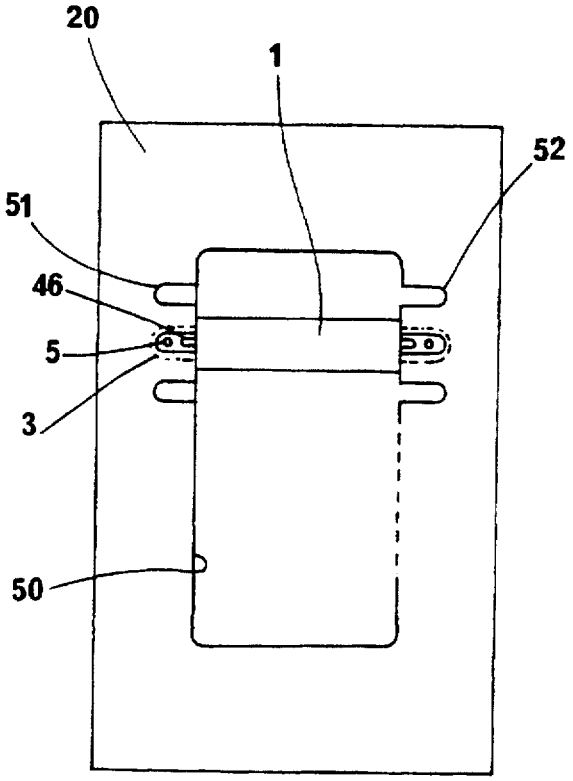
FIG. 8 represents a panel susceptible of receiving a series of devices according to the invention, corresponding to a fourth embodiment.
Figure 9:
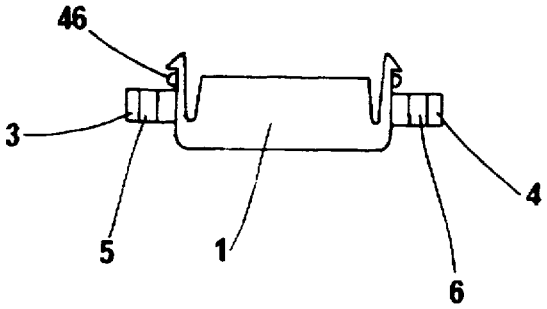
FIG. 9 is a front view of the device in FIG. 8.

In the fourth embodiment in FIGS. 8 and 9, the base-forming devices 1 according to the invention comprise joining pieces 3, 4 fitted with internal screw threads 5, 6 as in FIGS. 1 to 4.

The panel 20 comprises an opening 50 fitted laterally with oblong holes 51, 52 intended to replace the bores 21, 22, respectively, in FIG. 2. In order to enable the bases to be properly positioned in relation to the oblong holes 51, 52, the bases are fitted with indexing lugs 46 disposed laterally in the snap-in groove (9, 10 in FIG. 1A), i.e. in a zone corresponding to the thickness of the panel 20. When the bases are thus positioned, the relays can be secured to them by screwing through the oblong holes 51, 52.

The invention does away with the risk of losing metal parts by only providing for the utilisation of two major parts: the above-mentioned device and a relay 30 equipped with captive screws. Furthermore, the installation of a base embodying the invention can be performed manually, without using any tool, by means of pushing in the direction of the arrow 19, corresponding to a low insertion force.

I claim:

1. A device forming a plug base for an electric relay to be fit through an opening in a panel, comprising:

a rigid body having a plurality of electric sockets and a width;

an electric relay having pins engageable in respective electric sockets of said body and having a plugged position where said sockets and said pins are engaged and an approach position where said sockets and said pins are in contact;

snap-in resilient lugs located adjacent said body and being flexible between a first position where said lugs are elastically contracted towards the center of said body and a second position in which said lugs are in a normal non-contracted position;

wherein said rigid body does not deflect inwardly when said resilient lugs are moved to said elastically contracted position;

wherein each of said lugs has a width substantially equal to the width of said body; and wherein said relay, when said relay is in said plugged and said approach positions, prevents said resilient lugs from moving to said first position.

2. The device as claimed in claim 1, wherein said body and said snap-in resilient lugs have a snapped-in position with a predetermined clearance in relation to the corresponding face of said panel and wherein said resilient lugs have a shoulder forming a snap-in jaw.

3. The device as claimed in claim 1, wherein said resilient lugs each comprise a sloped plane so as to cause elastic retraction of said lugs when said device is inserted through the corresponding opening in said panel.

4. The device as claimed in claim 1, wherein said resilient lugs are delimited by blind vertical grooves in said body.

5. The device as claimed in claim 1, further comprising a joining piece and wherein said resilient lugs meet thereabove.

6. The device as claimed in claim 1, wherein said resilient lugs are at least partially recessed.

7. The device as claimed in claim 6, wherein said at least partial recess in each of said resilient lugs is provided with a passage for a sleeve tube forming a distance sleeve integral with said electric relay.

8. The device as claimed in claim 1, further comprising securing means are internal screw threads or mounted tapped inserts.

9. The device as claimed in claim 1, wherein said securing means of the device cooperate with complementary securing means of said electric relay made captive in relation to said relay.

* * * * *